US011220104B2

(12) United States Patent
Krause et al.

(10) Patent No.: US 11,220,104 B2
(45) Date of Patent: Jan. 11, 2022

(54) REDUCING INKJET AEROSOL

(71) Applicant: Hewlett-Packard Development Company, L.P., Spring, TX (US)

(72) Inventors: Steven Michael Krause, San Diego, CA (US); James Feinn, San Diego, CA (US); Hector Jose Lebron, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/764,342

(22) PCT Filed: Dec. 22, 2017

(86) PCT No.: PCT/US2017/068073
§ 371 (c)(1),
(2) Date: May 14, 2020

(87) PCT Pub. No.: WO2019/125480
PCT Pub. Date: Jun. 27, 2019

(65) Prior Publication Data

US 2020/0346454 A1 Nov. 5, 2020

(51) Int. Cl.
*B41J 2/045* (2006.01)

(52) U.S. Cl.
CPC ..... *B41J 2/04508* (2013.01); *B41J 2/04516* (2013.01); *B41J 2/04561* (2013.01); *B41J 2/04581* (2013.01)

(58) Field of Classification Search
CPC ..... B41J 2/04516
See application file for complete search history.

(56) References Cited

U.S. PATENT DOCUMENTS

| | | | | |
|---|---|---|---|---|
| 7,066,564 | B2 | 6/2006 | Holstun et al. | |
| 7,524,042 | B2 | 4/2009 | Weksler et al. | |
| 7,909,426 | B2 | 3/2011 | Kim | |
| 8,608,267 | B2 | 12/2013 | Therrien et al. | |
| 9,616,661 | B2 | 4/2017 | Pierik et al. | |
| 2006/0071957 | A1 | 4/2006 | Shang et al. | |
| 2009/0244163 | A1 | 10/2009 | Govyadinov | |
| 2010/0207989 | A1 | 8/2010 | Govyadinov | |
| 2012/0105526 | A1* | 5/2012 | Govyadinov | B41J 2/0459 347/10 |
| 2019/0152222 | A1* | 5/2019 | Cruz-Uribe | B41J 2/0459 |

FOREIGN PATENT DOCUMENTS

| | | |
|---|---|---|
| EP | 2836366 | 2/2015 |
| WO | WO-2012030344 A1 | 3/2012 |

OTHER PUBLICATIONS

Kwon, K.S. et al., "Measurement of Inkjet First-drop Behavior Using a High-speed Camera", Review of Scientific Instruments 87, 0351010 (2016), 11 pages.

* cited by examiner

*Primary Examiner* — Shelby L Fidler
(74) *Attorney, Agent, or Firm* — "HP Inc. Patent Department, "

(57) ABSTRACT

In an example implementation, a method of reducing inkjet aerosol in a fluid drop ejection system includes imaging fluid drops from an ejection event as the drops travel from an ejection nozzle toward a substrate, determining the momentum of each fluid drop from the imaging, comparing the momentum of each fluid drop with a threshold momentum, and determining that a fluid drop will become aerosol when its momentum does not exceed the threshold momentum.

13 Claims, 4 Drawing Sheets

REDUCING INKJET AEROSOL

BACKGROUND

Inkjet printing systems form printed images by ejecting print fluids onto a print target such as various print media. Examples of such printing systems include drop-on-demand, multi-pass scanning type systems, single-pass page-wide systems, and three-dimensional (3D) printing systems that print fluids onto layers of build material. In an example single-pass system, a fixed array of printheads extends the full width of a media page to allow the entire width of the page to be printed simultaneously as the page is moved past the printhead array in a continuous manner. In an example scanning type printing system, a scanning carriage can hold one or multiple printheads that scan back and forth across the width of a media page and print one swath of an image each time the page is incrementally advanced.

Such drop-on-demand inkjet systems can be further categorized based on different drop formation mechanisms. For example, a thermal bubble inkjet printer uses a heating element actuator in a fluid-filled chamber to vaporize fluid and create a bubble which forces a fluid drop out of a nozzle. A piezoelectric inkjet printer uses a piezoelectric material actuator on a wall of a fluid-filled chamber to generate a pressure pulse which forces a drop of fluid out of the nozzle. The proper design and maintenance of such inkjet printing systems helps to ensure quality printed output that is free from print defects.

BRIEF DESCRIPTION OF THE DRAWINGS

Examples will now be described with reference to the accompanying drawings, in which.

Throughout the drawings, identical reference numbers designate similar, but not necessarily identical, elements.

DETAILED DESCRIPTION

Figure 1:
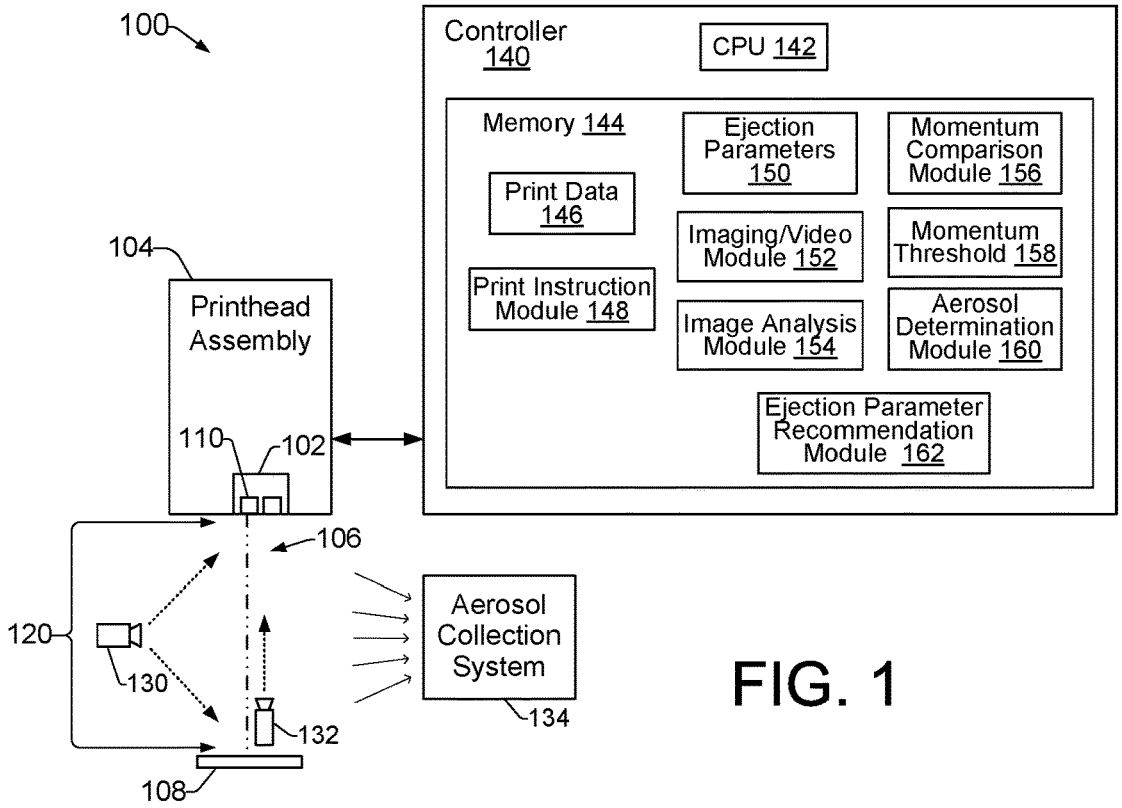
FIG. 1 shows a block diagram of an example inkjet aerosol reducing system suitable for evaluating aerosol generation from individual fluid ejection nozzles for a given set of nozzle ejection parameters.

Inkjet printing systems such as drop-on-demand, multi-pass scanning type systems and single-pass page-wide systems that implement drop formation mechanisms such as thermal element actuators (i.e., firing resistors) and piezoelectric material actuators, can be susceptible to a variety of adverse conditions that can degrade printer functionality and print quality. For example, such systems implement printheads comprising very small ejection nozzles that eject or fire small drops of liquid ink onto media substrates, which can generate aerosol. Aerosols generally comprise a mixture of fine liquid drops, and in the context of inkjet printing systems an aerosol can include very small liquid ink drops comprising dissolved colorants or pigments dispersed in a solvent. During ink drop ejections, aerosol drops generally do not have enough momentum to travel far enough and/or straight enough to strike the media substrate at an intended location to generate printed output. As a result, aerosol drops can often cause unwanted stains to develop on printed output, make printer components dirty, and degrade printer functionality, for example, by creating a coating over internal printer components such as sensors.

During extended periods of printing where many ink ejections are occurring from printhead nozzles, large quantities of aerosol can be generated. Aerosol generation can also occur during other system functions such as printhead start-up, printhead servicing, drop detection, printing alignments, and so on. In some examples, printhead servicing can include "spitting", which is the ejection of ink drops into a service station spittoon. During such printhead servicing, the effects of aerosol can be more pronounced. In general, aerosol can degrade the performance of surrounding printer components, and can affect the overall life and performance of an inkjet printing system.

Various methods have been developed to try and reduce inkjet aerosol. These include, for example, modifying components such as spittoons to try and capture more aerosol, and increasing ventilation using fans. Such solutions tend to cause significant increases in production costs and operational costs, however. Other methods of reducing inkjet aerosol involve evaluating aerosol generation for different operating conditions and parameters, and then adjusting those conditions and parameters to help minimize the aerosol generation. Unfortunately, these methods have previously included system-level testing involving extended ejection sequences, followed by qualitative evaluations of the amount aerosol collected around the print zone. Such system-level evaluations of aerosol generation for sets of operating conditions are time and resource demanding, and they provide no information on component-level dynamics. Qualitative strobe-based microscopy methods, taking a single image per ejection, have also have been used. However, these methods lack quantitative analysis and do not have the capability of full ejection tracking (i.e., numerous images covering an entire ejection).

Accordingly, example systems and methods described herein for reducing inkjet aerosol enable assessments of aerosol generation for given sets of nozzle ejection parameters that can be performed more quickly and with fewer resources than prior methods. The example systems and methods provide for the use of high speed microscopy and image processing to facilitate such quantitative assessments of aerosol generation for individual ejection nozzles under given sets of operating parameters. The reduction in time and resources that are used to perform the aerosol assessments allows for more extensive evaluation of different fluids and operating parameters, as well as enabling the observation of ejection dynamics which can help with the tuning of drop tail breakup to provide additional control over the number of aerosol drops that are generated per ejection.

In some examples, a sequence of ejections using a set of firing/ejection parameters is recorded using a high speed camera. A set of ejection parameters can include, for example, the frequency, voltage, pulse-length, and ink/fluid temperature used for a given ejection event. Video images from the camera can be processed to generate data on the fluid drops created from each ejection as the drops travel from an ejection nozzle toward a target media substrate. The data generated from the video images can include two-dimensional (2D) data that indicates the number of fluid drops produced per ejection, as well as the position, velocity, acceleration, and size of each drop. This information can then be used to identify which drops will not have enough momentum to reach the intended media substrate due to their relatively low speed and low mass. These low momentum drops can be further identified to be drops that will become aerosol drops prior to reaching the media substrate.

The video images further enable a visual inspection of drop tail breakup dynamics, which allows for tuning the tail breakup as noted above. The drop tail breakup can be tuned, for example, by evaluating, manipulating, and optimizing a range of ejection operating parameters in a manner that decreases the number of satellite drops (i.e., secondary drops that trail behind the main fluid drop) and increases the in-flight drop coalescence (i.e., the merging of drops in flight). Decreasing the number of satellite drops and increasing in-flight drop coalescence can both help to decrease the amount of low momentum aerosol drops.

In a particular example, a method of reducing inkjet aerosol in a fluid drop ejection system includes imaging fluid drops from an ejection event as the drops travel from an ejection nozzle toward a substrate. The imaging can include taking video images with a high-speed camera in burst mode, for example. The method includes determining the momentum of each fluid drop from the imaging, comparing the momentum of each fluid drop with a threshold momentum, and determining that a fluid drop will become aerosol when its momentum does not exceed the threshold momentum.

In another example, an inkjet aerosol reducing system includes a memory device comprising a set of ejection parameters to control an ejection of fluid drops from a fluid ejection nozzle. The memory device also includes a fluid drop momentum threshold associated with the set of ejection parameters. The system includes a processor programmed with an image analysis module to generate fluid drop data from video images of the fluid drops, where the fluid drop data includes a fluid drop momentum. The processor is also programmed with a momentum comparison module to compare the fluid drop momentum with the fluid drop momentum threshold and to determine if the fluid drop momentum exceeds the fluid drop momentum threshold. The result of the momentum comparison can be used to determine if a fluid drop will become aerosol.

In another example, a method of reducing inkjet aerosol in a fluid drop ejection system, includes establishing a set of ejection parameters for an ejection nozzle, and ejecting fluid drops from the nozzle in accordance with the set of ejection parameters. The method includes capturing video images of the fluid drops at a set time interval, determining a momentum of each fluid drop from the video images, comparing the momentum of each fluid drop to a momentum threshold value associated with the set of ejection parameters, determining that fluid drops whose momentum does not exceed the momentum threshold will become aerosol, and informing the fluid drop ejection system to establish a new set of ejection parameters based on the fluid drops that are determined to become aerosol.

FIG. 1 shows a block diagram of an example inkjet aerosol reducing system 100 suitable for evaluating aerosol generation from individual fluid ejection nozzles for a given set of nozzle ejection parameters, and for providing recommendations for adjusting the nozzle ejection parameters to help reduce the aerosol generation based on the evaluation. In some examples, the inkjet aerosol reducing system 100 may be implemented as part of a two-dimensional (2D) inkjet printing system that can print fluids onto print targets such as various print media. In some examples, the inkjet aerosol reducing system 100 may be implemented as part of a three-dimensional (3D) inkjet printing system that can print fluids onto a bed of build material. The example inkjet aerosol reducing system 100 comprises a number of components often implemented in different drop-on-demand inkjet printing systems, including a fluid drop jetting printhead 102 that can be part of a printhead assembly 104. A printhead assembly 104 can be implemented, for example, as a print bar supporting multiple printheads for use in a single-pass page-wide inkjet printing system, or a print cartridge mounted in a scanning assembly for use in a multi-pass scanning-type inkjet printing system.

In some examples, a fluid drop jetting printhead 102 can comprise a thermal inkjet (TIJ) printhead that implements thermal element actuators (i.e., firing resistors) to eject fluid 106 (e.g., ink drops) from a fluid-filled chamber through a nozzle in the printhead 102 onto a target media substrate 108 during an ejection event. While the fluid drop jetting printhead 102 is discussed herein as comprising a thermal inkjet printhead, in other examples the concepts discussed herein may be partly or fully applicable to other printhead types. For example, using the same or similar ejection parameters as those discussed with reference to a TIJ printhead, the concepts discussed herein can be applicable to piezoelectric printheads that implement a piezoelectric material actuator on the wall of an ink-filled chamber to generate a pressure pulse which forces a drop of ink out of the nozzle.

An example thermal inkjet printhead 102 can comprise one or multiple nozzles 110, each associated with an underlying fluid chamber (not shown) within the printhead 102, and further associated with a thermal resistor actuator (i.e., firing resistor, not shown). The thermal resistor actuator can be activated by the application of a voltage pulse which can cause the resistor to rapidly heat to a high temperature, which in turn can super heat fluid within the chamber that is in close proximity to the resistor. The super-heated fluid can vaporize and form a vapor bubble within the chamber that forces or ejects fluid from the chamber and out through the nozzle 110.

FIGS. 2*a*, 2*b*, 2*c* and 2*d*, represent examples of video images 112, 114, 116, and 118, respectively, that are intended to show examples of fluid 106 that has been ejected from a nozzle 110 as the fluid 106 travels through a print zone 120 toward a media substrate 108. In some examples, a print zone 120 can span a distance on the order of 1.2 millimeters between the nozzle 110 and the media substrate 108. In some examples, video images can be captured by a high speed camera 130 that captures images of the fluid 106 at time intervals such as a 2 microsecond time interval while the ejected fluid 106 travels through the 1.2 millimeter wide print zone 120. Thus, image 112 may be an image captured 2 microseconds prior to image 114, image 114 may be an image captured 2 microseconds before image 116, and image 116 may be an image captured 2 microseconds before image 118. In some examples, video images can also be captured by a low speed, high-resolution camera 132, directed upward toward the nozzle bore to enable capturing images of a drive bubble that forms to eject the fluid 106 from the nozzle 110.

Figures 2A, 2B, 2C, 2D:
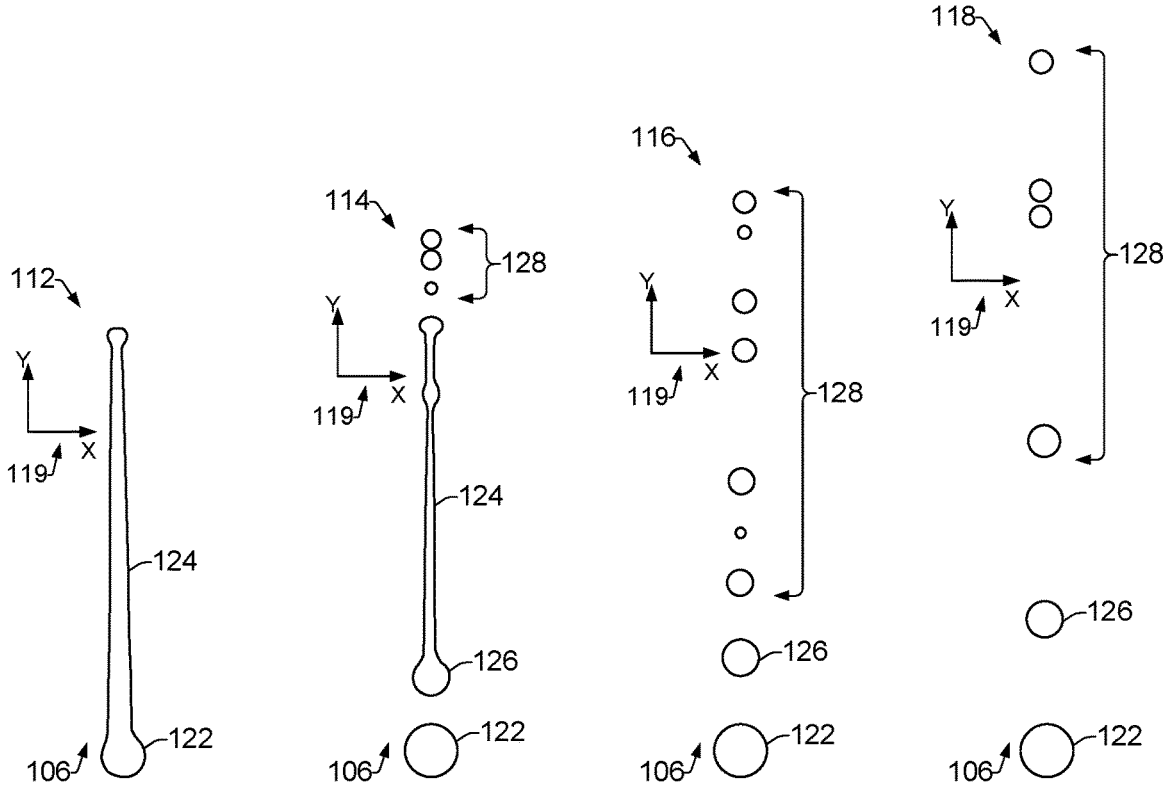
FIGS. 2*a*, 2*b*, 2*c* and 2*d*, show example representations of example video images that are intended to show examples of fluid drops that have been ejected from a nozzle.

As shown in FIGS. 2*a*, 2*b*, 2*c* and 2*d*, the ejected fluid 106 can change its form as it travels through the print zone 120 from the nozzle 110 toward the target media substrate 108. For example, as shown in FIG. 2*a*, as the fluid 106 exits the nozzle 110 it can be in the form of a small stream of fluid, or in the form of a main fluid drop 122 attached to a fluid drop tail 124. As the fluid 106 continues traveling through the print zone 120 between the nozzle 110 and the target media substrate 108, the fluid drop tail 124 can begin to break apart. For example, the fluid drop tail 124 can break up into different sized fluid drops that can grow farther apart or move closer together and coalesce into larger drops. Thus, the breakup of the fluid drop tail 124 can result in the formation of secondary fluid drops 126 and/or satellite drops 128, as shown in FIGS. 2*b*, 2*c*, and 2*d*. Accordingly, a single ejection event from a printhead nozzle 110 can result in one or multiple fluid drops that can include main fluid drops 122, secondary fluid drops 126, and satellite drops 128, that travel through the print zone 120 toward the target media substrate 108. In addition, as noted above, ejection events can also generate aerosol drops that do not have enough momentum to move through the print zone 120 and strike the target media substrate 108. In some examples, fluid drops such as satellite drops can become aerosol when they decrease in size and velocity, and/or take on trajectories that are not adequately directed toward the intended media substrate 108.

As shown in FIG. 1, an example inkjet aerosol reducing system 100 can include an aerosol collection system 134. The aerosol collection system 134 can comprise, for example, a vacuum system to vacuum up fine aerosol drops from in and around the area of the print zone 120. Removing the aerosol drops can help prevent the aerosol drops from contacting and coating components of the system 100, such as the cameras 130 and 132.

As noted above, 2D video images such as images 112, 114, 116, and 118 (FIGS. 2*a*, 2*b*, 2*c*, 2*d*), can be processed to determine information about the fluid drops generated from a nozzle ejection event. Because the video images are in 2D, the information and data generated from processing the images can be based on the relative positioning and size of the fluid drops within an X-Y plane 119. The relative X-Y coordinate positioning and sizes of the drops change from one image to the next as successive images are captured at a known time interval.

Figure 3:
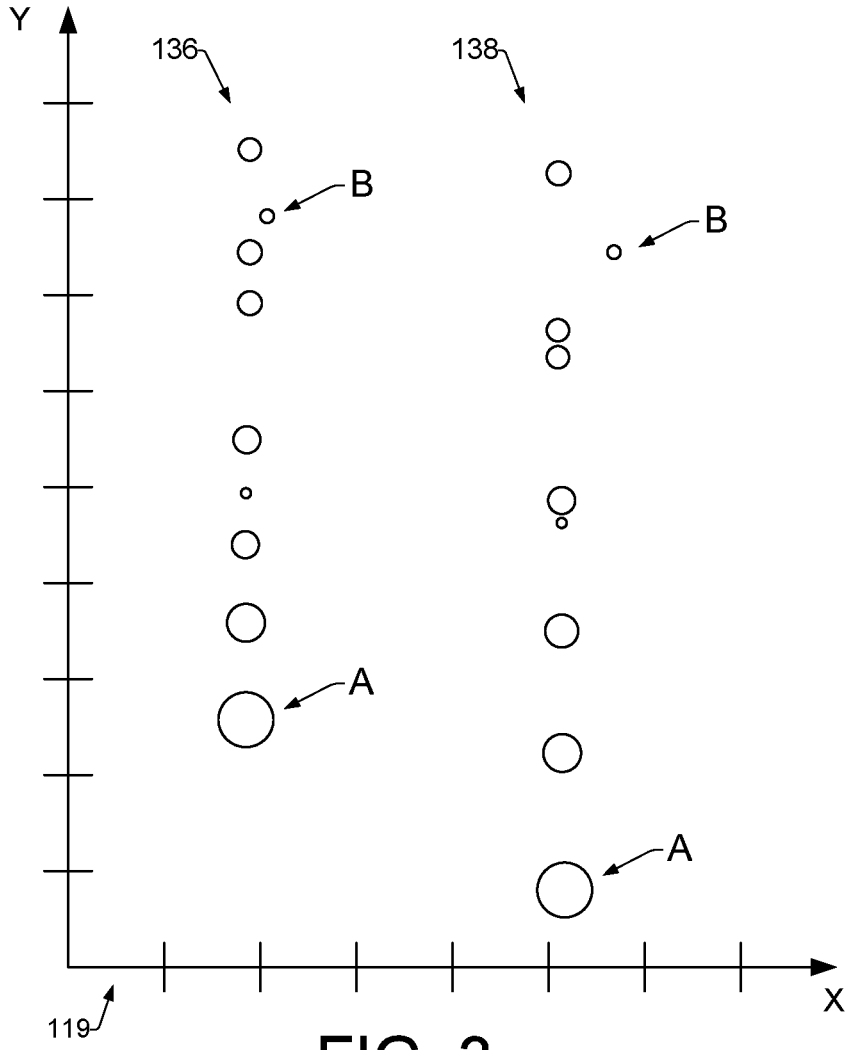
FIG. 3 shows two example video images of fluid drops generated from an ejection event, where the images have been captured in succession at a set time interval; and, FIGS. 4 and 5 are flow diagrams showing example methods of reducing inkjet aerosol in a fluid drop ejection system.

To help illustrate how the video images of fluid drops can be processed to generate data about the fluid drops, additional example images are shown in FIG. 3. FIG. 3 shows two example video images 136 and 138 of fluid drops generated from an ejection event, where the images have been captured in succession at a time interval such as a 2 microsecond interval. The images 136 and 138 are shown on the same X-Y graph 119 to help illustrate the relative changes in positions of the fluid drops in both the X and Y directions over the time interval of the image capture. Processing of the images 136 and 138 can provide fluid drop position information with respect to the X-Y graph 119. From one image to the next, such as from image 136 to image 138, captured at a time interval such as a 2 microsecond interval, the changing Y position of an example fluid drop A can be used to determine the Y-direction velocity of the fluid drop A. The relative size and mass of fluid drop A can also be determined, for example, using X-Y position information and bounding box information to help determine the drop dimensions. The Y-direction velocity and mass of fluid drop A can be used to determine the momentum of fluid drop A toward striking the intended media substrate 108 (FIG. 1). Additional position information from an additional image (not shown) can be used to determine the acceleration of the fluid drop A. In a similar manner, a changing X position for an example fluid drop B can be used to determine a X-direction velocity of the fluid drop B. Fluid drops with greater Y-direction velocities and larger mass can have sufficient momentum to strike the media substrate 108, while fluid drops with too much X-direction velocities and smaller mass may not have sufficient momentum to strike the media substrate 108.

Referring again to FIG. 1, an example inkjet aerosol reducing system 100 additionally includes an example controller 140. The controller 140 can control various operations of the inkjet aerosol reducing system 100 to facilitate, for example, the ejection of fluid from nozzles 110, the evaluation of aerosol generation from individual fluid ejection nozzles for a given set of nozzle ejection parameters, providing recommendations for adjusting the nozzle ejection parameters to help reduce the aerosol generation based on the evaluation, and so on.

As shown in FIG. 1, an example controller 140 can include a processor (CPU) 142 and a memory 144. The controller 140 may additionally include other electronics (not shown) for communicating with and controlling various components of the inkjet aerosol reducing system 100. Such other electronics can include, for example, discrete electronic components and/or an ASIC (application specific integrated circuit). Memory 144 can include both volatile (i.e., RAM) and nonvolatile memory components (e.g., ROM, hard disk, optical disc, CD-ROM, magnetic tape, flash memory, etc.). The components of memory 144 comprise non-transitory, machine-readable (e.g., computer/processor-readable) media that can provide for the storage of machine-readable coded program instructions, data structures, program instruction modules, JDF (job definition format), and other data and/or instructions executable by a processor 142 of the inkjet aerosol reducing system 100.

Examples of instructions stored in memory 144 and executable by processor 142 can include instructions associated with modules 148, 152, 154, 156, 160, and 162, while examples of stored data can include data stored in modules 146, 150, and 158. In general, instruction modules 148, 152, 154, 156, 160, and 162, include programming instructions executable by processor 142 to cause the inkjet aerosol reducing system 100 to perform operations related to imaging (i.e., capturing video images) fluid drops generated by an ejection event as the drops travel from an ejection nozzle toward a media substrate, evaluating aerosol generation from the ejection nozzle for a given set of nozzle ejection parameters, and providing recommendations for adjusting the nozzle ejection parameters to help reduce the aerosol generation based on the evaluation.

More specifically, a print instruction module 148 includes instructions to control the operation of printhead 102 and nozzle(s) 110 for ejecting fluid drops according to printing data 146 and operational information stored in a set of ejection parameters 150. The imaging/video module 152 includes instructions for controlling cameras 130 and 132, including synchronizing the capture of video images with ejection events from nozzle(s) 110. The image analysis module 154 includes instructions for analyzing video images captured by cameras 130 and 132, and for determining from the video images, the number of fluid drops generated from an ejection event and additional fluid drop data including X & Y drop velocities, drop sizes, drop accelerations, and the momentum of each fluid drop. The momentum comparison module 156 includes instructions for comparing drop momentum values determined from the image analysis with a current momentum threshold 158 associated with the current set of ejection parameters 150. The aerosol determination module 160 includes instructions for receiving the drop momentum comparison results and determining from those results if fluid drops from an ejection event will become aerosol. In some examples, the aerosol determination module 160 can receive an external user input, such as information about fluid drop trajectory or fluid drop acceleration, to use as an additional factor when determining if a fluid drop will become aerosol. The ejection parameter recommendation module 162 includes instructions for evaluating aerosol levels (e.g., based on fluid drop aerosol determinations) and drop data from the image analysis, in order to make recommendations for adjusting the current ejection parameters 150. Ejection parameters 150 can then be adjusted to a new set of parameters, along with a corresponding adjustment to the momentum threshold 158, and further ejections can be performed and evaluated using the new set of ejection parameters 150 and momentum threshold 158.

Figure 4:
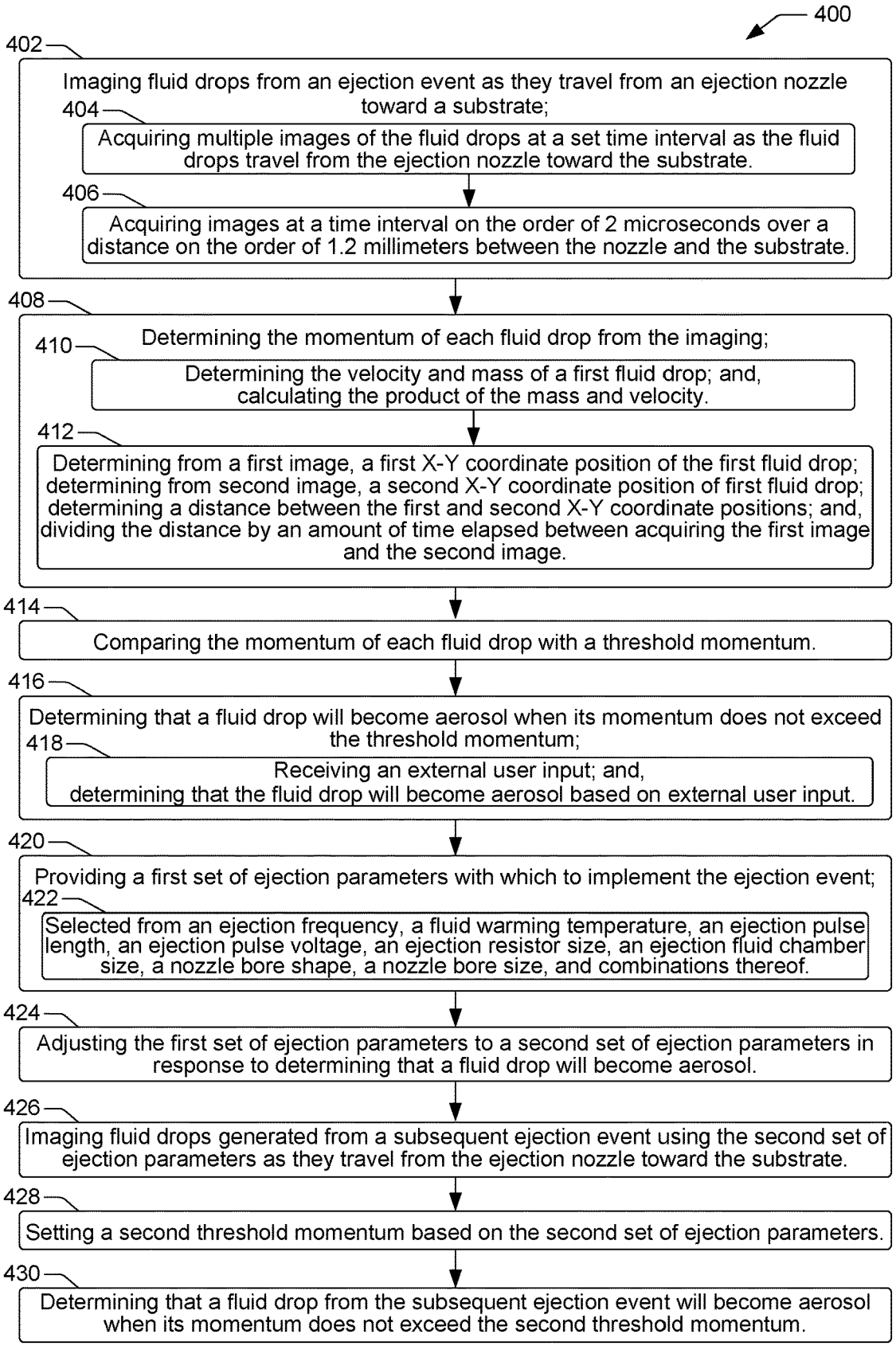
Figure 5:
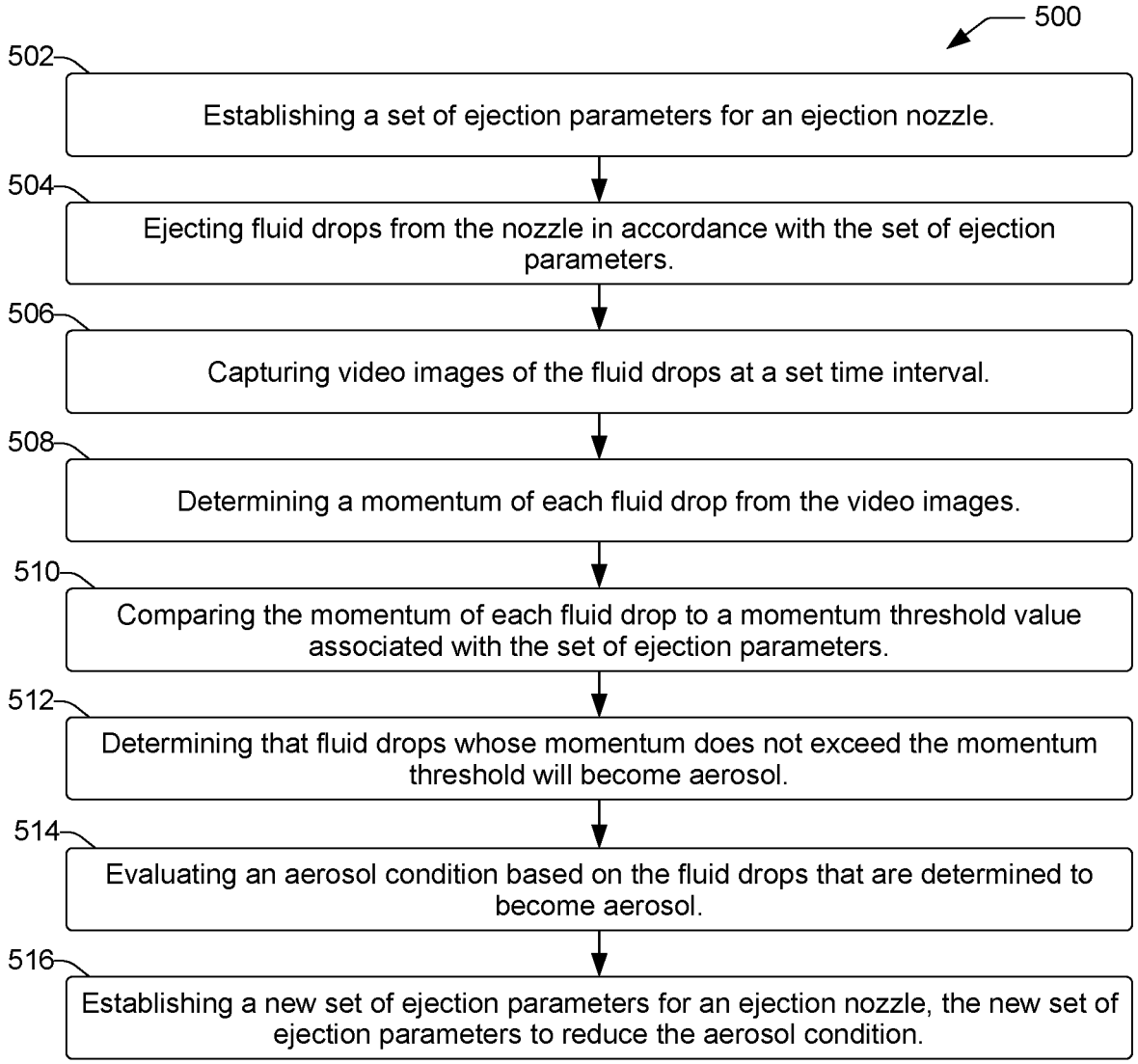

FIGS. 4 and 5 are flow diagrams showing example methods 400 and 500 of reducing inkjet aerosol in a fluid drop ejection system. Methods 400 and 500 are associated with examples discussed above with regard to FIGS. 1-3, and details of the operations shown in methods 400 and 500 can be found in the related discussion of such examples. The operations of methods 400 and 500 may be embodied as programming instructions stored on a non-transitory, machine-readable (e.g., computer/processor-readable) medium, such as memory/storage 144 shown in FIG. 1. In some examples, implementing the operations of methods 400 and 500 can be achieved by a controller, such as a controller 140 of FIG. 1, reading and executing the programming instructions stored in a memory 144. In some examples, implementing the operations of methods 400 and 500 can be achieved using an ASIC and/or other hardware components alone or in combination with programming instructions executable by a controller 140.

The methods 400 and 500 may include more than one implementation, and different implementations of methods 400 and 500 may not employ every operation presented in the respective flow diagrams of FIGS. 4 and 5. Therefore, while the operations of methods 400 and 500 are presented in a particular order within their respective flow diagrams, the order of their presentations is not intended to be a limitation as to the order in which the operations may actually be implemented, or as to whether all of the operations may be implemented. For example, one implementation of method 400 might be achieved through the performance of a number of initial operations, without performing other subsequent operations, while another implementation of method 400 might be achieved through the performance of all of the operations.

Referring now to the flow diagram of FIG. 4, an example method 400 of reducing inkjet aerosol in a fluid drop ejection system begins at block 402 with imaging fluid drops from an ejection event as they travel from an ejection nozzle toward a substrate. In some examples, imaging fluid drops can include acquiring multiple images of the fluid drops at a set time interval as the fluid drops travel from the ejection nozzle toward the substrate, as shown at block 404. In some examples, acquiring multiple images can include acquiring images at a time interval on the order of 2 microseconds over a distance on the order of 1.2 millimeters between the nozzle and the substrate, as shown at block 406. The method can continue at block 408 with determining the momentum of each fluid drop from the imaging. As shown at block 410, determining momentum includes determining the velocity and mass of a first fluid drop, and calculating the product of the mass and velocity. As shown at block 412, determining the velocity comprises determining from a first image, a first X-Y coordinate position of the first fluid drop, determining from second image, a second X-Y coordinate position of first fluid drop, determining a distance between the first and second X-Y coordinate positions, and dividing the distance by an amount of time elapsed between acquiring the first image and the second image (e.g., 2 microseconds).

The method 400 continues at block 414 with comparing the momentum of each fluid drop with a threshold momentum. The method includes determining that a fluid drop will become aerosol when its momentum does not exceed the threshold momentum, as shown at block 416. In some examples, as shown at block 418, determining that a fluid drop will become aerosol can include receiving an external user input, and determining that the fluid drop will become aerosol based on external user input. The method can include providing a first set of ejection parameters with which to implement the ejection event, as shown at block 420. As shown at block 422, the ejection parameters can be select from an ejection frequency, a fluid warming temperature, an ejection pulse length, an ejection pulse voltage, an ejection resistor size, an ejection fluid chamber size, a nozzle bore shape, a nozzle bore size, and combinations thereof.

The method 400 can continue at block 424 with adjusting the first set of ejection parameters to a second or new set of ejection parameters in response to determining that a fluid drop will become aerosol. In some examples this can include informing the fluid drop ejection system to establish the new set of ejection parameters based on the fluid drops that are determined to become aerosol. The method can include imaging fluid drops generated from a subsequent ejection event using the second set of ejection parameters as the fluid drops travel from the ejection nozzle toward the substrate, as shown at block 426. As shown at block 428, a second threshold momentum can be set based on the second set of ejection parameters. The method can also include determining that a fluid drop from the subsequent ejection event will become aerosol when its momentum does not exceed the second threshold momentum, as shown at block 430.

Referring now to FIG. 5, another example method 500 of reducing inkjet aerosol in a fluid drop ejection system begins at block 502 with establishing a set of ejection parameters for an ejection nozzle. The method 500 can continue with ejecting fluid drops from the nozzle in accordance with the set of ejection parameters, as shown at block 504. As shown at blocks 506, 508, 510, and 512, respectively, the method includes capturing video images of the fluid drops at a set time interval, determining a momentum of each fluid drop from the video images, comparing the momentum of each fluid drop to a momentum threshold value associated with the set of ejection parameters, and determining that fluid drops whose momentum does not exceed the momentum threshold will become aerosol. As shown at blocks 514 and 516, the method can also include evaluating an aerosol condition based on the fluid drops that are determined to become aerosol, and establishing a new set of ejection parameters for an ejection nozzle, where the new set of ejection parameters are to help reduce the aerosol condition.

What is claimed is:

1. A method of reducing inkjet aerosol in a fluid drop ejection system, comprising:

imaging fluid drops from an ejection event as they travel from an ejection nozzle toward a substrate, the ejection event implemented with a first set of ejection parameters;

determining from the imaging, the momentum of each fluid drop;

comparing the momentum of each fluid drop with a threshold momentum set based on the first set of ejection parameters;

determining that a fluid drop will become aerosol when its momentum does not exceed the threshold momentum; and, adjusting the first set of ejection parameters to a second set of ejection parameters in response to determining that a fluid drop will become aerosol.

2. A method as in claim 1, wherein imaging comprises acquiring multiple images of the fluid drops at a set time interval as the fluid drops travel from the ejection nozzle toward the substrate.

3. A method as in claim 2, wherein acquiring multiple images comprises acquiring images at a time interval on the order of 2 microseconds over a distance on the order of 1.2 millimeters between the nozzle and the substrate.

4. A method as in claim 1, wherein determining that a fluid drop will become aerosol further comprises:

receiving an external user input; and, determining that the fluid drop will become aerosol based on the external user input.

5. A method as in claim 1, wherein determining the momentum comprises:

determining from the imaging, the velocity and the mass of a first fluid drop; and, calculating the product of the mass and velocity.

6. A method as in claim 5, wherein determining the velocity from the imaging comprises:

determining from a first image, a first X-Y coordinate position of the first fluid drop;

determining from a second image, a second X-Y coordinate position of the first fluid drop;

determining a distance between the first and second X-Y coordinate positions; and, dividing the distance by an amount of time elapsed between acquiring the first image and the second image.

7. A method as in claim 1, further comprising:

imaging fluid drops generated from a subsequent ejection event using the second set of ejection parameters as they travel from the ejection nozzle toward the substrate.

8. A method as in claim 7, further comprising:

setting a second threshold momentum based on the second set of ejection parameters; and, determining that a fluid drop from the subsequent ejection event will become aerosol when its momentum does not exceed the second threshold momentum.

9. A method as in claim 1, wherein ejection parameters from the first set of ejection parameters are selected from the group consisting of an ejection frequency, a fluid warming temperature, an ejection pulse length, an ejection pulse voltage, an ejection resistor size, an ejection fluid chamber size, a nozzle bore shape, a nozzle bore size, and combinations thereof.

10. An inkjet aerosol reducing system comprising:

a memory device comprising a set of ejection parameters to control an ejection of fluid drops from a fluid ejection nozzle, and a fluid drop momentum threshold associated with the set of ejection parameters; and, a processor programmed with an image analysis module to generate from video images of the fluid drops, fluid drop data that includes a fluid drop momentum, and a momentum comparison module to compare the fluid drop momentum with the fluid drop momentum threshold and to determine if the fluid drop momentum exceeds the fluid drop momentum threshold, the processor further programmed with an ejection parameter recommendation module to recommend an adjustment to the set of ejection parameters based on evaluating the fluid drop data and aerosol determinations, the recommended adjustment to the set of ejection parameters to reduce aerosol generated during the ejection of fluid drops from the fluid ejection nozzle.

11. An inkjet aerosol reducing system as in claim 10, further comprising:

the processor programmed with an aerosol determination module to determine if a fluid drop associated with the fluid drop momentum will become aerosol based on the comparison of the fluid drop momentum with the fluid drop momentum threshold and an external user input.

12. A method of reducing inkjet aerosol in a fluid drop ejection system, comprising:

establishing a set of ejection parameters for an ejection nozzle in a fluid drop ejection system;

ejecting fluid drops from the nozzle in accordance with the set of ejection parameters;

capturing video images of the fluid drops at a set time interval;

determining a momentum of each fluid drop from the video images;

comparing the momentum of each fluid drop to a momentum threshold value associated with the set of ejection parameters;

determining that fluid drops whose momentum does not exceed the momentum threshold will become aerosol; and, informing the fluid drop ejection system to establish a new set of ejection parameters based on the fluid drops that are determined to become aerosol.

13. A method as in claim 12, further comprising:

evaluating an aerosol condition based on the fluid drops that are determined to become aerosol; and, establishing the new set of ejection parameters to reduce the aerosol condition.

* * * * *